US008599084B2

(12) United States Patent
Wong et al.

(10) Patent No.: US 8,599,084 B2
(45) Date of Patent: Dec. 3, 2013

(54) MOBILE COMMUNICATION DEVICE AND ANTENNA

(75) Inventors: Kin-Lu Wong, Taipei Hsien (TW); Po-Wei Lin, Taipei Hsien (TW); Chih-Hua Chang, Taipei Hsien (TW)

(73) Assignee: Acer Incorporated, Hsichih, Taipei Hsien (TW)

( * ) Notice: Subject to any disclaimer, the term of this patent is extended or adjusted under 35 U.S.C. 154(b) by 340 days.

(21) Appl. No.: 13/088,561

(22) Filed: Apr. 18, 2011

(65) Prior Publication Data

US 2012/0098721 A1 Apr. 26, 2012

(30) Foreign Application Priority Data

Oct. 22, 2010 (TW) ..... 99136065 A

(51) Int. Cl.
*H01Q 9/00* (2006.01)

(52) U.S. Cl.
USPC ..... 343/749

(58) Field of Classification Search
USPC ..... 343/700 MS, 749, 767
See application file for complete search history.

(56) References Cited

U.S. PATENT DOCUMENTS

| | | | | |
|---|---|---|---|---|
| 2,942,263 | A * | 6/1960 | Baldwin | 343/767 |
| 6,664,931 | B1 * | 12/2003 | Nguyen et al. | 343/767 |
| 7,612,676 | B2 * | 11/2009 | Yuen et al. | 340/572.7 |
| 8,085,202 | B2 * | 12/2011 | Ayatollahi et al. | 343/700 MS |
| 8,115,686 | B2 * | 2/2012 | Mumbru et al. | 343/702 |
| 2007/0257842 | A1 | 11/2007 | Tseng | |
| 2009/0153407 | A1 | 6/2009 | Zhang et al. | |
| 2010/0245176 | A1 | 9/2010 | Wong et al. | |

FOREIGN PATENT DOCUMENTS

| | | |
|---|---|---|
| EP | 2 157 659 | 2/2010 |
| TW | 200908445 | 2/2009 |
| WO | WO 2006/114477 | 11/2006 |
| WO | WO 2010/010529 | 1/2010 |

OTHER PUBLICATIONS

European Search Report dated Oct. 19, 2011.
TW Office Action dated Jun. 19, 2013.
English Abstract translation of TW200908445 (Published Feb. 16, 2009, included with the foreign reference).

* cited by examiner

*Primary Examiner* — Seung Lee
(74) *Attorney, Agent, or Firm* — McClure, Qualey & Rodack, LLP

(57) ABSTRACT

A mobile communication device is provided. The mobile communication device includes a system circuit board with a surface, a ground plane having a monopole slot on the surface, a microstrip feedline, and a metal element, wherein the ground plane has a longer edge and a shorter edge. The monopole slot has a first operating band and a second operating band. The microstrip feedline is located on the system circuit board, wherein one end of the microstrip feedline passes over the monopole slot, and the other end of the microstrip feedline is connected to a signal source. The metal element is electrically connected to the shorter edge of the ground plane, and is substantially perpendicular to the ground plane. A distance between the open end of the monopole slot and the shorter edge of the ground plane where the metal element is connected is shorter than 0.05 wavelength of the lowest operating frequency of the first operating band.

20 Claims, 7 Drawing Sheets

MOBILE COMMUNICATION DEVICE AND ANTENNA

CROSS REFERENCE TO RELATED APPLICATIONS

This Application claims priority of Taiwan Patent Application No. 099136065 filed on Oct. 22, 2010, the entirety of which is incorporated by reference herein.

BACKGROUND OF THE INVENTION

1. Field of the Invention

The disclosure relates generally to a mobile communication device, and more particularly relates to a mobile communication device with a monopole slot antenna.

2. Description of the Related Art

With the progress of wireless technology, the wireless communication industry has benefited. Mobile communication devices are required to be light and small, such that the integration of an internal antenna and other electronic elements on the system circuit board of the device becomes one of the essential design considerations.

A monopole slot antenna or open-slot antenna is one of the promising antennas for mobile communication devices. However, in order to generate a wide operating band to cover the WWAN (wireless wide area network) operation, the monopole slot antenna is generally required to be disposed at the center of the ground plane of the mobile communication device to excite the wideband resonant mode of the ground plane. For example, U.S. Pat. No. 6,618,020 B2, "Monopole slot antenna" discloses such an antenna. However, such a design will complicate the circuit floor planning and signal line routing on the system circuit board, which greatly limits its possible application in a practical mobile phone. The problem may be solved by disposing the monopole slot close to one shorter edge of the ground plane. However, this method will greatly decrease the achievable bandwidth of the excited resonant mode of the ground plane of the device, thus reducing the operating bandwidth of the antenna.

BRIEF SUMMARY OF THE INVENTION

To solve the described problems, the invention provides a mobile communication device, having a monopole slot antenna or an open-slot antenna. The monopole slot antenna or the open-slot antenna may be on the ground plane of the mobile communication device and may generate a first (lower) operating band and a second (higher) operating band. The distance between an open end of the monopole slot and a shorter edge of the ground plane is shorter than 0.05 wavelength of the lowest operating frequency of the first operating band. Thus, the monopole slot is close to the shorter edge of the ground plane. The mobile communication device may further have a metal element, which is electrically connected to the shorter edge of the ground plane near the monopole slot and is substantially perpendicular to the ground plane. The metal element effectively increases the distance between the open end of the monopole slot and the shorter edge of the ground plane, thus, exciting a wideband resonant mode of the ground plane. Therefore, the first operating band may be from about 824 MHz to 960 MHz, and the second operating band may be from about 1710 MHz to 2170 MHz to achieve penta-band WWAN operation. On the other hand, the first operating band may be from about 704 MHz to 960 MHz, and the second operating band may be from about 1710 MHz to 2690 MHz to achieve eight-band LTE/WWAN operation.

The mobile communication device may comprise: a system circuit board, a ground plane, a microstrip feedline, and a metal element. The ground plane has a monopole slot and is disposed on a surface of the system circuit board, wherein the ground plane has a longer edge and a shorter edge, and the monopole slot has a first (lower) operating band and a second (higher) operating band. The length of the monopole slot is less than 0.2 wavelength of the lowest operating frequency of the first operating band, and the open end of the monopole slot is at the longer edge of the ground plane. The microstrip feedline is located on the system circuit board, wherein one end of the microstrip feedline passes over the monopole slot, and the other end of the microstrip feedline is electrically connected to a signal source, wherein a distance between the position at which the microstrip feedline passes over the monopole slot and the open end of the monopole slot is larger than 0.3 length of the monopole slot. The metal element is electrically connected to or electrically connected through an inductive element to the shorter edge of the ground plane and substantially perpendicular to the ground plane, wherein a distance between the open end of the monopole slot and the shorter edge of the ground plane is shorter than 0.05 wavelength of the lowest operating frequency of the first operating band, i.e. the monopole slot is away from the center of the system circuit board. Therefore, the problem concerning the layout of circuits and signal lines may be solved.

In the mobile communication device of the invention, the shape of the metal element may be rectangular, C-shaped, or L-shaped. The metal element may be bent, such that a part of the metal element is substantially parallel to the system circuit board and results in a lower height of the metal element. Lower height of the metal element can help the metal element be embedded into a slim mobile communication device. The length of the monopole slot is less than 0.2 wavelength of the lowest operating frequency of the first operating band, and a distance between the position at which the microstrip feedline passes over the monopole slot and the open end of the monopole slot is larger than 0.3 length of the monopole slot to excite the lowest resonant mode of the monopole slot to combine the resonant mode of the ground plane to form the first operating band. On the other hand, a higher-order resonant mode of the monopole slot can be excited to form the second operating band.

BRIEF DESCRIPTION OF THE DRAWINGS

The invention will become more fully understood by referring to the following detailed description with reference to the accompanying drawings, wherein.

DETAILED DESCRIPTION OF THE INVENTION

Figure 1:
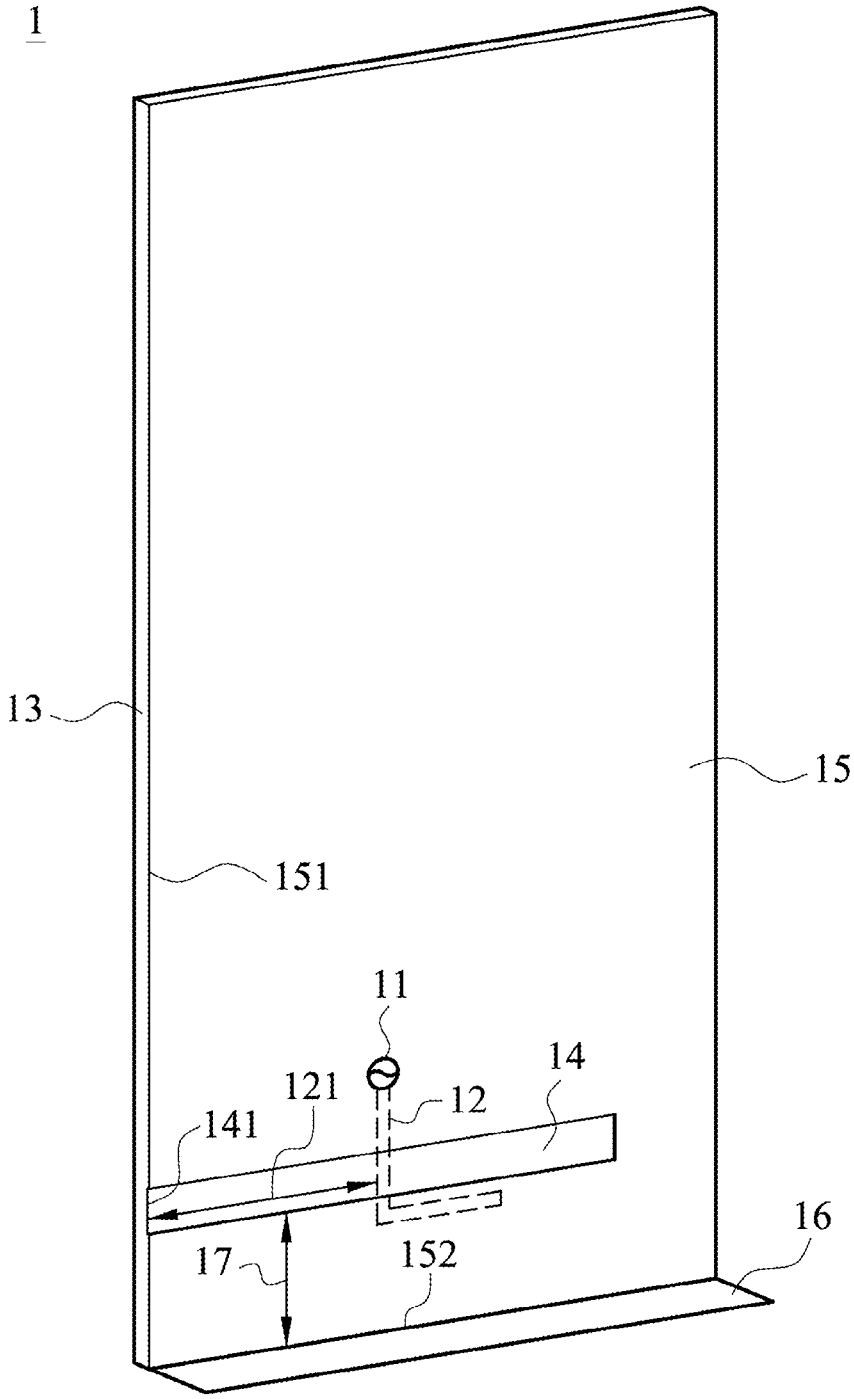
FIG. 1 is a diagram illustrating a mobile communication device according to an embodiment of the invention.

FIG. 1 is a diagram illustrating a mobile communication device 1 according to an embodiment of the invention. In one exemplary embodiment, the mobile communication device 1 of FIG. 1 may comprise: a system circuit board 13, a ground plane 15 having a monopole slot 14, a microstrip feedline 12, and a metal element 16. The open end 141 of the monopole slot 14 is located at a longer edge 151 of the ground plane 15 and near a shorter edge 152 of the ground plane 15. The microstrip feedline 12 is located on a surface of the system circuit board 13 opposite to the other surface where the ground plane 15 is located. One end of the microstrip feedline 12 passes over the monopole slot 14, and the other end of the microstrip feedline 12 is electrically connected to a signal source 11. The distance between the open end 141 of the monopole slot 14 and the shorter edge 152 of the ground plane 15 is the distance 17, wherein the distant 17 is shorter than 0.05 wavelength of the lowest operating frequency of the first operating band 21. The distance between the microstrip feedline 12 and the open end 141 of the monopole slot 14 is the distance 121, wherein the distance 121 is larger than 0.3 length of the monopole slot 14. The monopole slot 14 is away from the center of the system circuit board 13. Therefore, the problems concerning the layout of circuits and signal lines may be solved. The metal element 16 is electrically connected to the ground plane 15 and substantially perpendicular to the ground plane 15. The portion between the monopole slot 14 and the shorter edge 152 of the ground plane 15 can be used for accommodating some electronic elements inside of the mobile communication device, such as a USB (Universal Serial Bus) port. The operating principle of the antenna is that the monopole slot 14 is located on the ground plane 15 of the mobile communication device 1 and excites the fundamental resonant mode of the monopole slot 14. Then, the monopole slot 14 combines the fundamental resonant mode with the excited resonant mode of the ground plane 15 to form the first (lower-frequency) operating band 21. Also, the higher-order resonant mode of the monopole slot 14 can be excited to form the second (higher-frequency) operating band 22. The metal element 16 can effectively lengthen the distance between the monopole slot 14 and the shorter edge 152 of the ground plane 15, and then the resonant mode of the ground plane 15 can be excited to achieve wideband operation. The first operating band 21 may range from about 824 MHz to 960 MHz and the second operating band 22 may range from about 1710 MHz to 2170 MHz to cover penta-band WWAN operation. In addition, the first operating band 21 may range from about 704 MHz to 960 MHz and the second operating band 22 may range from about 1710 MHz to 2690 MHz to cover eight-band LTE/WWAN operation.

Figure 2:
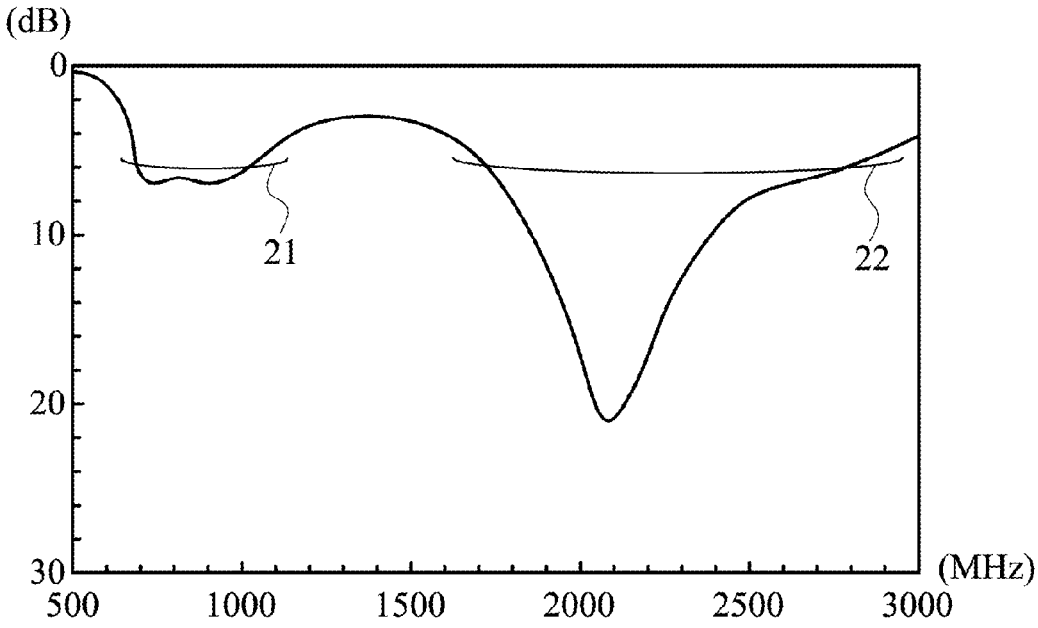
FIG. 2 is a diagram of return loss of an antenna according to an embodiment of the invention.

FIG. 2 is a diagram of return loss of an antenna according to an embodiment of the invention. The size of the mobile communication device 1 is as follows: the length, width, and thickness of the system circuit board 13 are about 115 mm, 60 mm, and 0.8 mm, respectively; the ground plane 15 is printed on the system circuit board 13; the length and width of the monopole slot 14 are about 50 mm and 4 mm, respectively; the distance 17 is about 17 mm, approximately equal to 0.04 wavelength of the lowest operating frequency (about 700 MHz) of the first operating band 21; the distance 121 is about 22 mm, approximately equal to 0.44 length of the monopole slot 14; the length and width of the metal element 16 are about 60 mm and 10 mm, respectively. According to the results of experiments and 6-dB return loss, the first operating band 21 may cover the two-band GSM850/900 operation or three-band LTE700/GSM850/900 operation, and the second operating band 22 may cover the three-band GSM1800/1900/UMTS operation or five-band GSM1800/1900/UMTS/LTE2300/2500 operation. In conclusion, the antenna can cover the penta-band WWAN operation or eight-band LTE/WWAN operation.

Figure 3:
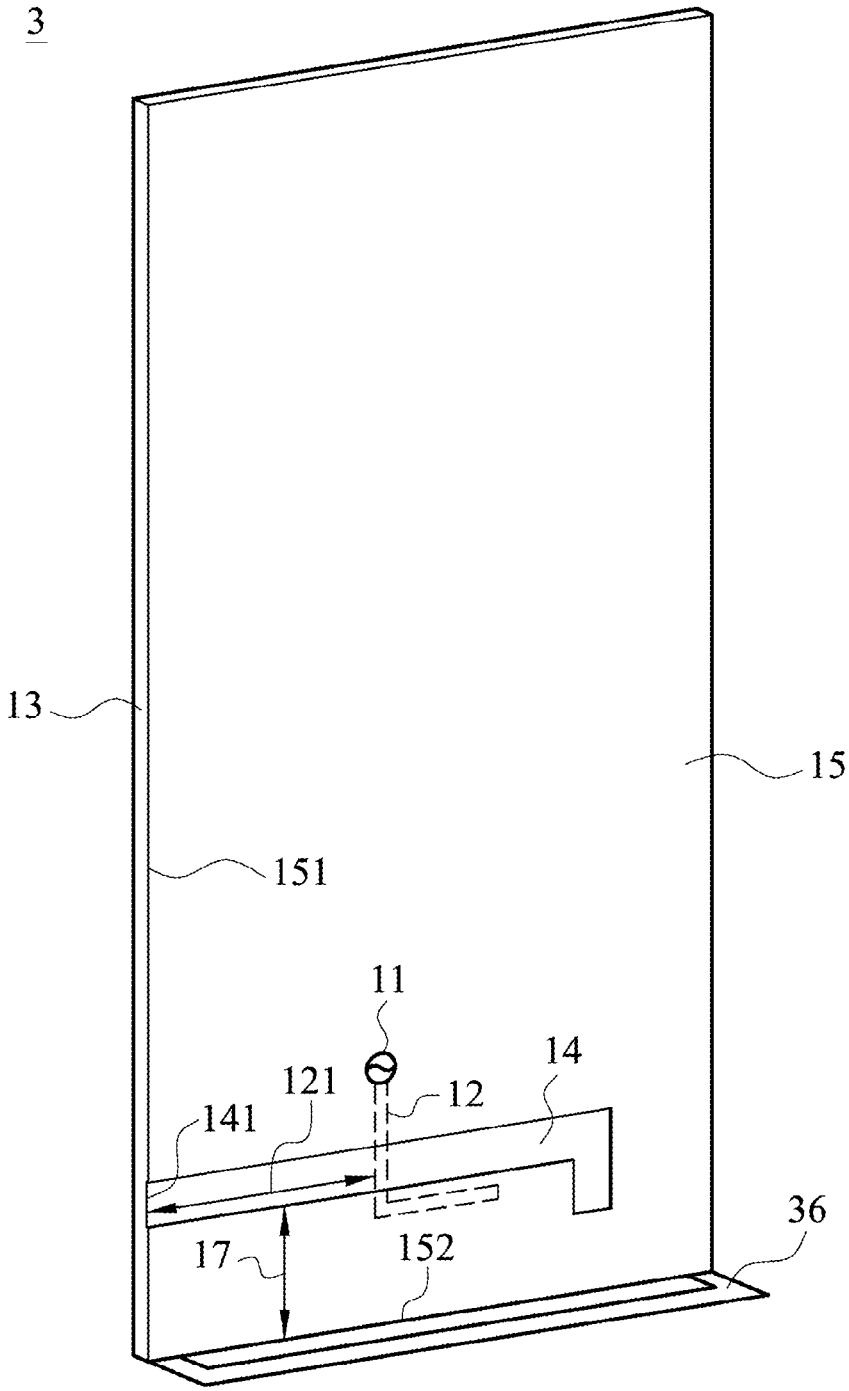
FIG. 3 is a diagram illustrating a mobile communication device according to an embodiment of the invention.

FIG. 3 is a diagram illustrating a mobile communication device 3 according to an embodiment of the invention. The difference between the mobile communication device 3 and the mobile communication device 1 is the monopole slot 14 having at least one bent portion and the C-shaped metal element 36. The bending of the monopole slot 14 decreases a length thereof. The space between the C-shaped metal element 36 and the ground plane 15 could be used for accommodating a USB port or other electronic elements. The structures of the mobile communication device 3 and the mobile communication device 1 are similar, so their effects are also similar.

Figure 4:
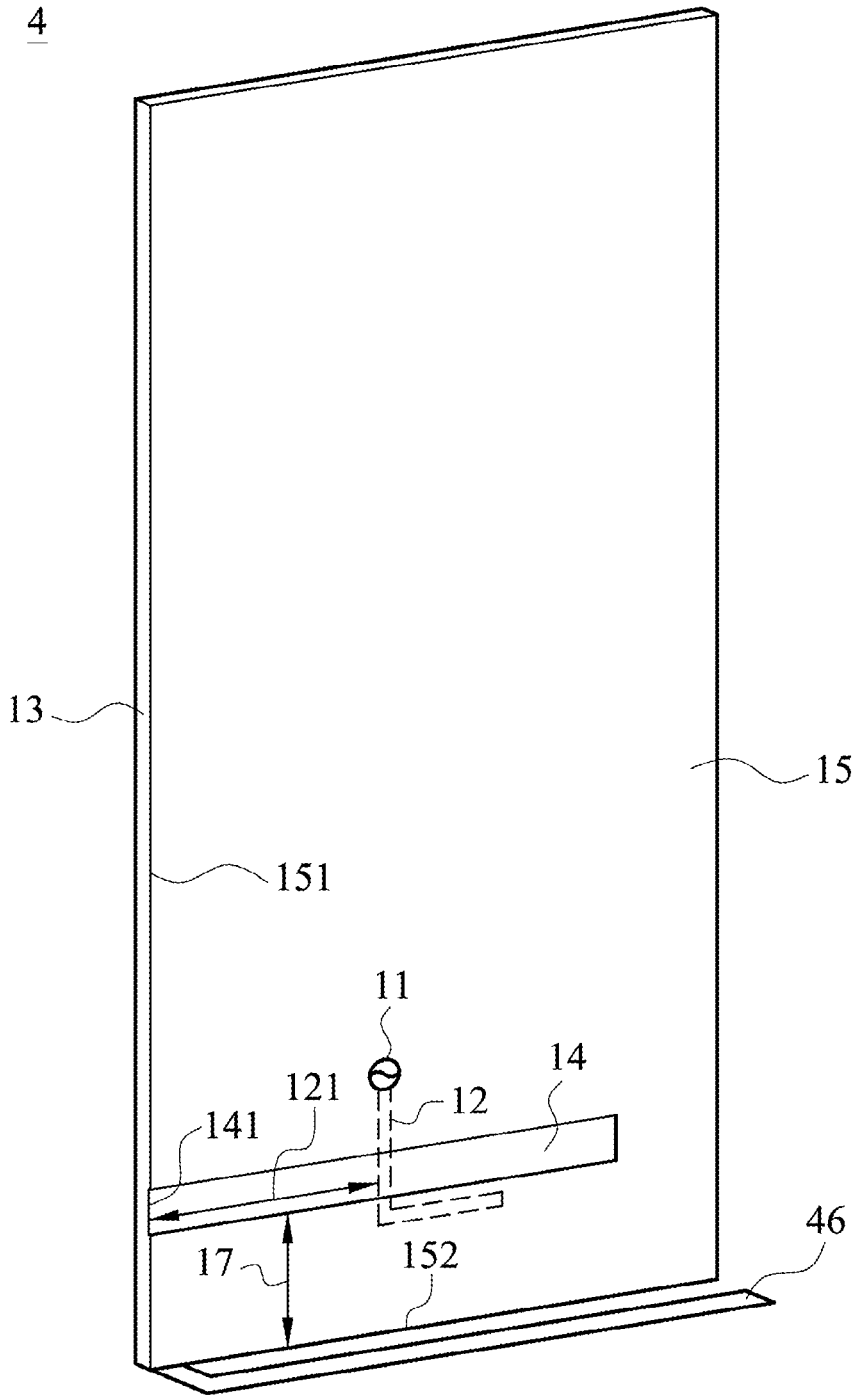
FIG. 4 is a diagram illustrating a mobile communication device according to an embodiment of the invention.

FIG. 4 is a diagram illustrating a mobile communication device 4 according to an embodiment of the invention. The difference between the mobile communication device 4 and the mobile communication device 1 is the L-shaped metal element 46, wherein one end is electrically connected to the ground plane 15 and the other end is open-circuited. The space between the L-shaped metal element 46 and the ground plane 15 is used for accommodating a USB ports or other electronic elements. The structures of the mobile communication device 4 and the mobile communication device 1 are similar, so their effects are also similar.

Figure 5:
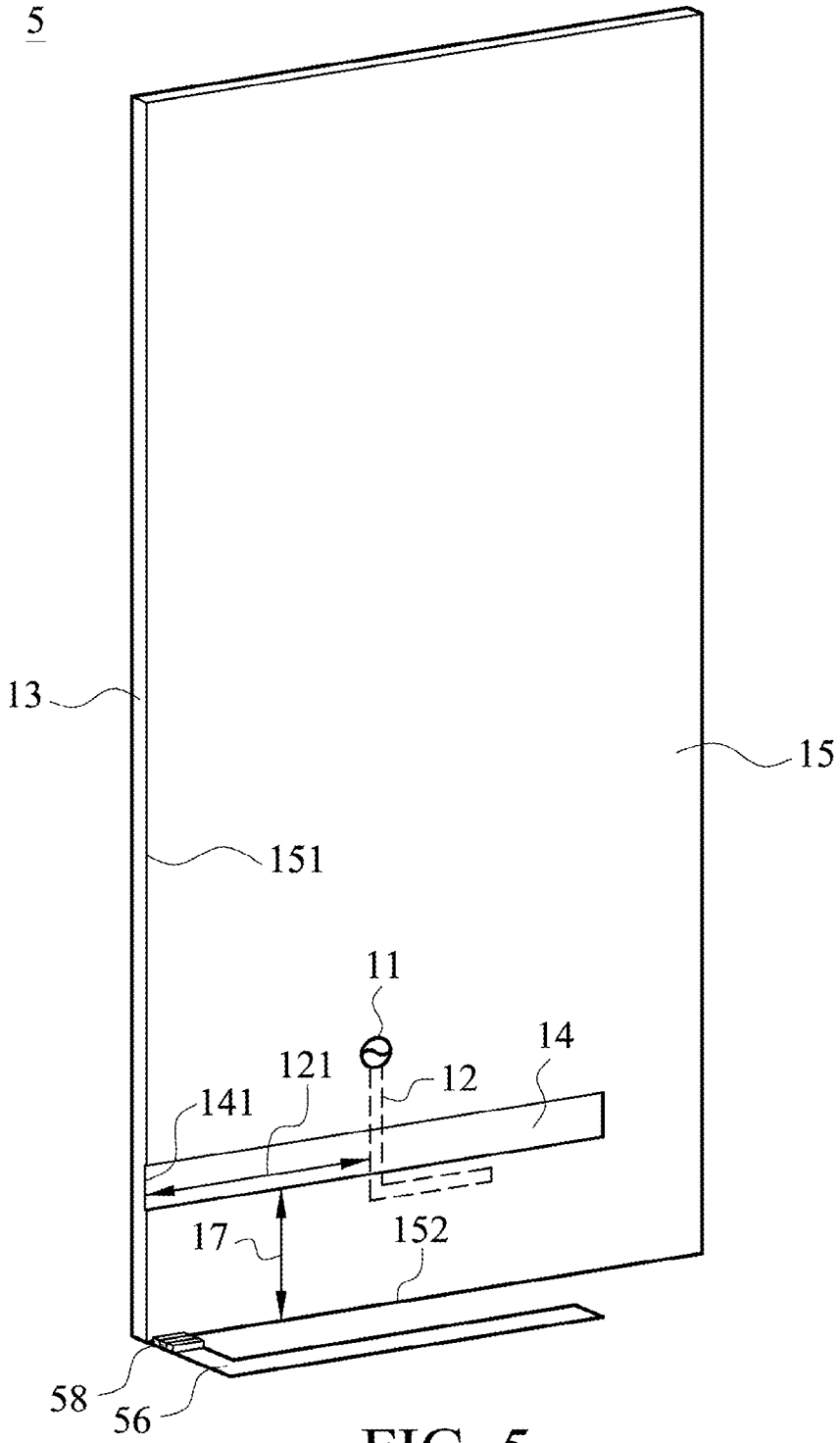
FIG. 5 is a diagram illustrating a mobile communication device according to an embodiment of the invention.

FIG. 5 is a diagram illustrating a mobile communication device 5 according to an embodiment of the invention. The difference between the mobile communication device 5 and the mobile communication device 1 is the metal element 56 connected through an inductive element, such as a chip inductor 58, to the ground plane 15. The chip inductor 58 can provide additional inductance and reduce the required length of the metal element 56 in order to excite the resonant mode of the ground plane 15, achieving wideband operation. The structures of the mobile communication device 5 and the mobile communication device 1 are similar, so their effects are also similar.

Figure 6:
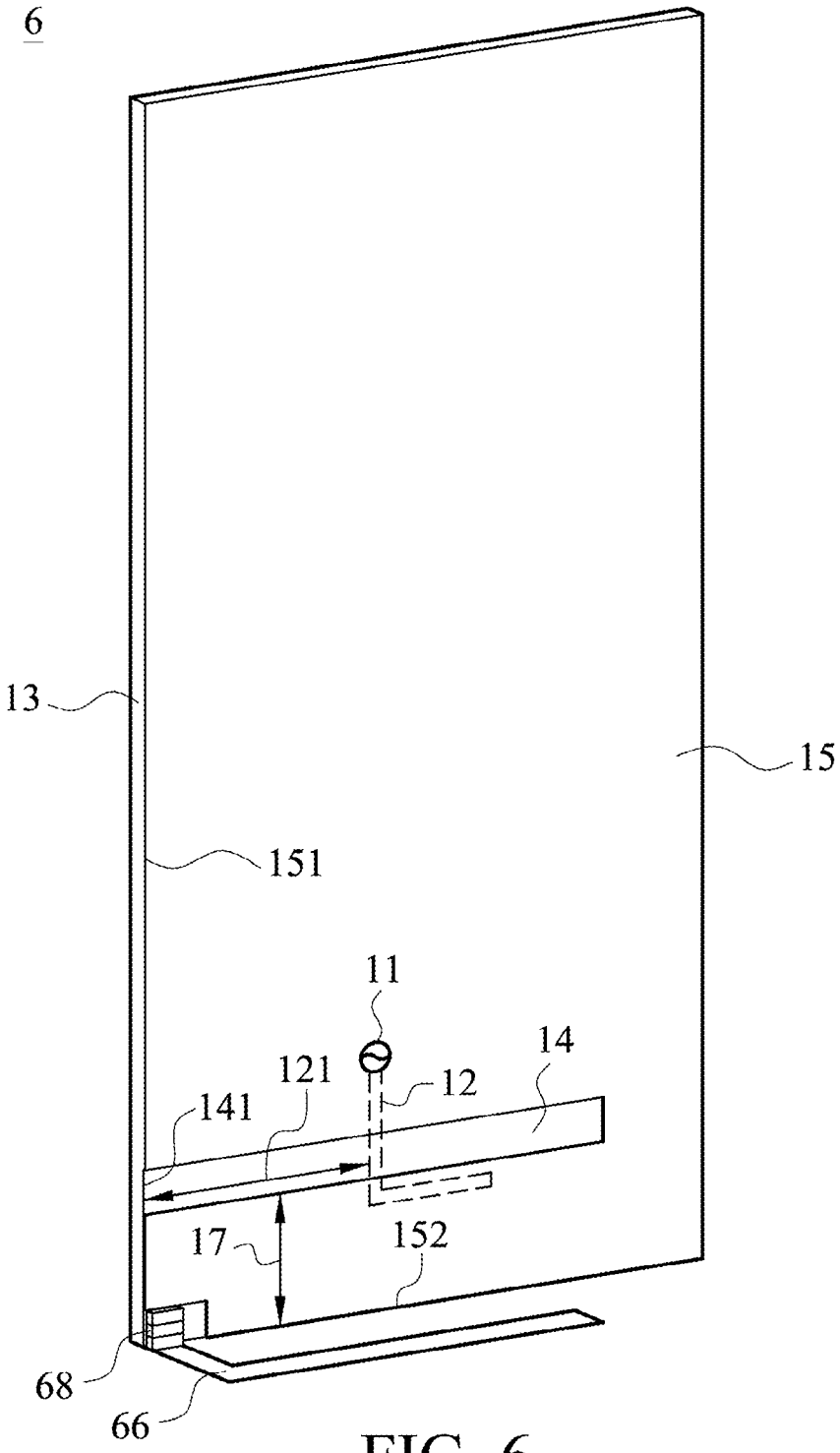
FIG. 6 is a diagram illustrating a mobile communication device according to an embodiment of the invention.

FIG. 6 is a diagram illustrating a mobile communication device 6 according to an embodiment of the invention. The difference between the mobile communication device 6 and the mobile communication device 1 is the metal element 66 connected through an inductive element, such as a chip inductor 68, to the ground plane 15. Located on the system circuit board 13, the chip inductor 68 can provide additional inductance and reduce the required length of the metal element 66 in order to excite the resonant mode of the ground plane 15 and achieve wideband operation. The structures of the mobile communication device 6 and the mobile communication device 1 are similar, so their effects are also similar.

Figure 7:
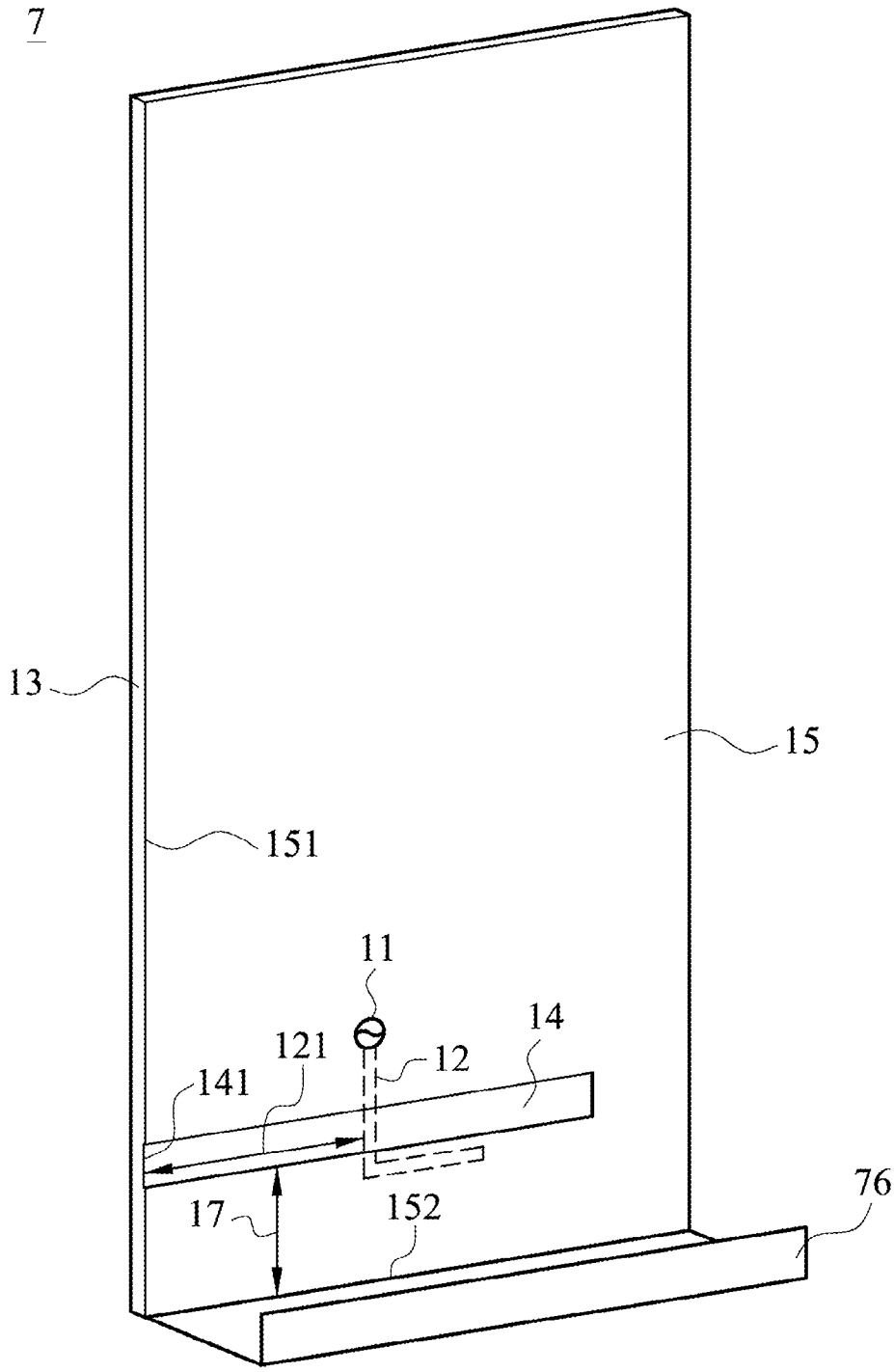
FIG. 7 is a diagram illustrating a mobile communication device according to an embodiment of the invention.

FIG. 7 is a diagram illustrating a mobile communication device 7 according to an embodiment of the invention. The difference between the mobile communication device 7 and the mobile communication device 1 is the metal element 76 having a bent portion. The bent portion makes part of the metal element 76 substantially parallel to the system circuit board 13, reducing a height of the metal element 76 to be embedded in a slim mobile communication device. The structures of the mobile communication device 7 and the mobile communication device 1 are similar, so their effects are also similar.

It will be apparent to those skilled in the art that various modifications and variations can be made in the invention. It is intended that the standard and examples be considered as exemplary only, with a true scope of the disclosed embodiments being indicated by the following claims and their equivalents

What is claimed is:

1. A mobile communication device, comprising:

a system circuit board with a surface;

a ground plane having a monopole slot on the surface, wherein the ground plane has a longer edge and a shorter edge, and the monopole slot has a first operating band and a second operating band;

a microstrip feedline located on the system circuit board, wherein one end of the microstrip feedline passes over the monopole slot, and the other end of the microstrip feedline is electrically connected to a signal source; and a metal element electrically connected to the shorter edge of the ground plane and perpendicular to the ground plane, wherein a distance between the open end of the monopole slot and the shorter edge of the ground plane is shorter than 0.05 wavelength of the lowest operating frequency of the first operating band.

2. The mobile communication device as claimed in claim 1, wherein the first operating band is from about 824 MHz to 960 MHz and the second operating band is from about 1710 MHz to 2170 MHz.

3. The mobile communication device as claimed in claim 1, wherein the first operating band is from about 704 MHz to 960 MHz and the second operating band is from about 1710 MHz to 2690 MHz.

4. The mobile communication device as claimed in claim 1, wherein the metal element is of a rectangular shape, a C-shape, or an L-shape.

5. The mobile communication device as claimed in claim 1, wherein the metal element has a bent portion, making part of the metal element parallel to the system circuit board.

6. The mobile communication device as claimed in claim 1, wherein the length of the monopole slot is shorter than 0.2 wavelength of the lowest operating frequency of the first operating band, and the open end of the monopole slot is at the longer edge of the ground plane.

7. The mobile communication device as claimed in claim 1, wherein a distance between the position at which the microstrip feedline passes over the monopole slot and the open end of the monopole slot is larger than 0.3 length of the monopole slot.

8. The mobile communication device as claimed in claim 1, wherein the metal element is electrically connected through an inductive element to the ground plane.

9. The mobile communication device as claimed in claim 8, wherein the metal element is of an L-shape.

10. The mobile communication device as claimed in claim 8, wherein the metal element has a bent portion, making part of the metal element parallel to the system circuit board.

11. An antenna, comprising:

a ground plane having a monopole slot, wherein the ground plane has a longer edge and a shorter edge, and the monopole slot has a first operating band and a second operating band;

a microstrip feedline, wherein one end of the microstrip feedline passes over the monopole slot, and the other end of the microstrip feedline is electrically connected to a signal source; and a metal element electrically connected to the shorter edge of the ground plane and perpendicular to the ground plane, wherein a distance between the open end of the monopole slot and the shorter edge of the ground plane is shorter than 0.05 wavelength of the lowest operating frequency of the first operating band.

12. The antenna as claimed in claim 11, wherein the first operating band is from about 824 MHz to 960 MHz and the second operating band is from about 1710 MHz to 2170 MHz.

13. The antenna as claimed in claim 11, wherein the first operating band is from about 704 MHz to 960 MHz and the second operating band is from about 1710 MHz to 2690 MHz.

14. The antenna as claimed in claim 11, wherein the metal element is of a rectangular shape, a C-shape, or an L-shape.

15. The antenna as claimed in claim 11, wherein the metal element has a bent portion, making part of the metal element parallel to the system circuit board.

16. The antenna as claimed in claim 11, wherein the length of the monopole slot is shorter than 0.2 wavelength of the lowest operating frequency of the first operating band, and the open end of the monopole slot is at the longer edge of the ground plane.

17. The antenna as claimed in claim 11, wherein a distance between the position at which the microstrip feedline passes over the monopole slot and the open end of the monopole slot is larger than 0.3 length of the monopole slot.

18. The antenna as claimed in claim 11, wherein the metal element is electrically connected through an inductive element to the ground plane.

19. The antenna as claimed in claim 18, wherein the metal element is of an L-shape.

20. The antenna as claimed in claim 18, wherein the metal element has a bent portion, making part of the metal element parallel to the ground plane.

* * * * *